US005120199A

United States Patent [19]

Youngs et al.

[11] Patent Number: 5,120,199

[45] Date of Patent: Jun. 9, 1992

[54] CONTROL SYSTEM FOR VALVELESS METERING PUMP

[75] Inventors: Randall E. Youngs, Bedford, Tex.; Guillermo P. Pardinas, Miami, Fla.

[73] Assignee: Abbott Laboratories, Abbott Park, Ill.

[21] Appl. No.: 722,992

[22] Filed: Jun. 28, 1991

[51] Int. Cl.[5] ..... F04B 49/00

[52] U.S. Cl. ..... 417/18; 417/12

[58] Field of Search ..... 417/18, 19, 20, 492, 417/500; 123/449; 91/61; 92/31, 106

[56] References Cited

U.S. PATENT DOCUMENTS 4,904,163 2/1990 Tachi et al. ..... 417/500 X 4,919,595 4/1990 Likuski et al. ..... 417/18

*Primary Examiner*—Leonard E. Smith

*Attorney, Agent, or Firm*—Richard D. Schmidt

[57] ABSTRACT

A control system for the working piston of a valveless metering pump for the precision delivery of fluids to a plurality of sequentially spaced output ports is adapted to control and alter the speed of rotation of the pump piston depending on predetermined angles of rotation of the piston as it cycles.

19 Claims, 4 Drawing Sheets

CONTROL SYSTEM FOR VALVELESS METERING PUMP

BACKGROUND OF THE INVENTION

1. Field of the Invention

The invention is generally related to control systems for valveless metering pumps for delivering precise volumes of fluid and is specifically related to an electronic control circuit for a micro-fluid pump for precisely dispensing reagents in assay tests.

2. Description of the Prior Art

This invention is related to the co-pending application entitled: VALVELESS METERING PUMP WITH RECIPROCATING, ROTATING PISTON, Ser. No. 07/648,242, by G. Pardinas, filed on Jan. 31, 1991 and assigned to the assignee of this application.

It is known to use assay testing to determine the presence of infectious diseases such as, hepatitis, syphilis and the HIV virus in the presence of blood serum. In a typical procedure, a precise volume of a biological sample is disposed in a test receptacle and a reagent is added to the sample to perform an immunoassay using an automated analyzer. Typically, the reagent is delivered in precise volume to the test site. The reagent volume for each sample can be in the range of 50 to 100 microliters and must be dispensed within a plus or minus 0.5 microliter accuracy and precision with less than one percent coefficient of variance.

It has become common practice that each pump may deliver a specific reagent to each of one or more test locations and, in the prior art, a valve mechanism is used to control the flow of the reagent from first one station and then to the other.

Because of the high precision requirements of pump systems for delivering reagents, the drop size, the condition of the meniscus at the end of the outlet ports and the pressure variation due to valve movement must all be taken into consideration to assure accurate test samples. For example, the minuscule pumping action inherent in shifting a valve from one position to another is of critical significance when dealing with the volumes commonly associated with assay type testing. This, coupled with the requirement that the components of the pump which come into contact with the reagent must be of an inert material such as tetrafluro plastics and/or ceramics or the like has led to very expensive and complex designs. Unfortunately, the more complex the design the greater the likelihood for error in manufacturing and assembly, further increasing the cost by requiring tight tolerances to minimize the effect of tolerance stacking. In addition, more complex systems with the associated number of moving parts contribute to field failure and maintenance cost.

More recently, valveless, positive displacement metering pumps have been successfully employed in applications where safe and accurate handling of fluids is required. The valveless pumping function is accomplished by the simultaneous rotation and reciprocation of a piston in a work chamber. The piston head containing the work chamber and piston is mounted such that it may be swiveled with respect to the rotating drive. The degree of angle controls the stroke and length and in turn, the flow rate. This type of pump has been found to be useful in performing accurate transfers of both gaseous and liquid fluids.

An example of a valveless positive displacement pump is disclosed in U.S. Pat. No. 4,008,003. The pump includes a cylinder divided into a pair of working chambers, each of the chambers communicating with an inlet and an outlet port. The pump disclosed in the U.S. Pat. No. 4,008,003 patent does not lend itself to accurate calibration for metering and dispensing fluids in the precise volumes called for in assay type tests. The piston stroke is not easily adjusted and the angular displacement of the ports cannot be readily calibrated. Another example of a valveless metering pump using a tiltable housing to control the piston stroke is disclosed in the co-pending application Ser. No. 07/463,260, entitled: PUMP WITH MULTI-PORT DISCHARGE, filed Jan. 10, 1990, now U.S. Pat. No. 5,015,157 with the co-inventors G. Pardinas, R. W. Jaekel and D. Pinkerton.

The valveless metering pump specifically designed for assay type testing and for providing accurate and precise delivery of fluids to test receptacles is disclosed in the afore-mentioned related application entitled: VALVELESS METERING PUMP WITH RECIPROCATING, ROTATING PISTON, Ser. No. 07/648,242. The valveless metering pump there shown provides a fluid delivery system particularly suited for precision delivery of fluid reagents to a test sample in an assay test in a dependable and reliable manner. The pump design includes a minimum number of moving parts, is valveless, flexible in configuration and is easy to assemble with minimum risk of tolerance stacking. The pump is designed to have a broad reagent compatibility and is capable of dispensing fluid volumes in the range of 50–100 microliters per port within plus or minus 0.5 microliters of accuracy and a precision of less than one percent coefficient of variance.

SUMMARY OF THE INVENTION

The control circuit for a valveless metering pump as disclosed in the subject invention provides means for providing increased accuracy for a fluid delivery system, particularly in an application for precision delivery of fluid reagents to a test sample in an assay test. It has been found that even in the most advanced designs, additional precision and accuracy can be achieved by controlling the speed of the pump as it completes its cycle. The present invention provides for a control circuit which is coupled with a sensor for monitoring the precise location of the pump piston throughout its cycle. The pump direction and speed is controlled in response to the location of the piston in the cycle for accurately controlling and dispensing fluids out of each of a plurality of outlet ports.

It has been found that the pressure differential of the fluid as it is released from the sequential outlet ports can affect the quantity of the fluid delivered to the test site. The present invention compensates for the inaccuracies due to pressure differential by increasing and decreasing the speed of the pump as it completes its cycle, to maintain a constant flow as the piston pumps fluids through the multiple outlet ports.

Specifically, the sensor identifies a preselected point in the pump cycle where the change in speed of the pump of the reciprocating and rotating piston can increase or decrease the flow of fluids from the outlets. In the preferred embodiment, the control circuit is operative to increase the speed of the piston as it moves from the first outlet port to the second outlet port to increase the flow of fluids through the second outlet port irrespective of the pressure differential in the working chamber due to fluids being first released through the first outlet port in the sequence.

Means are provided to generate a start signal for initiating the pump cycle. At this point, the pump is at rest and accelerates from a zero speed to a first operating speed. Typically, the pump is at the first operating speed before or by the time the piston is in communication with the first sequential outlet port. The pump continues to operate at this speed until a second signal is generated, altering the speed to a second level as the piston comes into communication with the next sequential outlet port. The pump then operates at this second speed until the cycle is complete and a signal is received to return the pump to a rest condition.

In this manner, the fluid dispensed from both the first and second outlet ports may be balanced irrespective of the pressure differential in the working chamber of the pump.

In the preferred embodiment, the control circuit is also operative to permit reverse motion of the piston to further control and balance the discharge at the two outlet ports and to purge the lines associated with the ports, when desired.

In addition, an optional test circuit is provided for cycling the pump and balancing the outlet ports prior to installation or during troubleshooting.

It is, therefore, an object and feature of the subject invention to provide a control system for a valveless, positive displacement metering pump for accurately and precisely dispensing minute volumes of fluid from a plurality of sequentially disposed outlet ports.

It is another object and feature of the invention to provide a control system for a valveless, positive displacement metering pump which permits the balancing of the discharge fluid from a plurality of sequential outlet ports irrespective of the pressure differential in the working chamber of the piston when it is in contact with each of the sequential outlet ports.

It is yet another object and feature of the subject invention to provide for a control system for a valveless, positive displacement metering pump, having means for driving the pump in either the forward or the reverse direction for purging of the discharge ports of fluids, where desired.

It is also an object and feature of the present invention to provide for an optional test circuit to be associated with the control circuit for a valveless, positive displacement metering pump, to permit cycling and calibration of the pump prior to installation or during troubleshooting.

Other objects and features of the invention will be readily apparent from the drawing and description of the preferred embodiment which follows.

DETAILED DESCRIPTION OF THE PREFERRED EMBODIMENT

The subject invention is directed to a control system for operating a valveless metering pump for delivering precise volumes of fluid and is particularly suited for controlling a microfluid pump for precisely dispensing reagents in assay tests. An example of a valveless pump adapted for use in connection with the subject invention is disclosed in the co-pending application, Ser. No. 07/648,242, entitled: "VALVELESS METERING PUMP WITH RECIPROCATING, ROTATING PISTON" by G. Pardinas, filed on Jan. 31, 1991, and assigned to Abbott Laboratories, Inc., the assignee of the subject application, said application being incorporated by reference herein.

Figure 1:
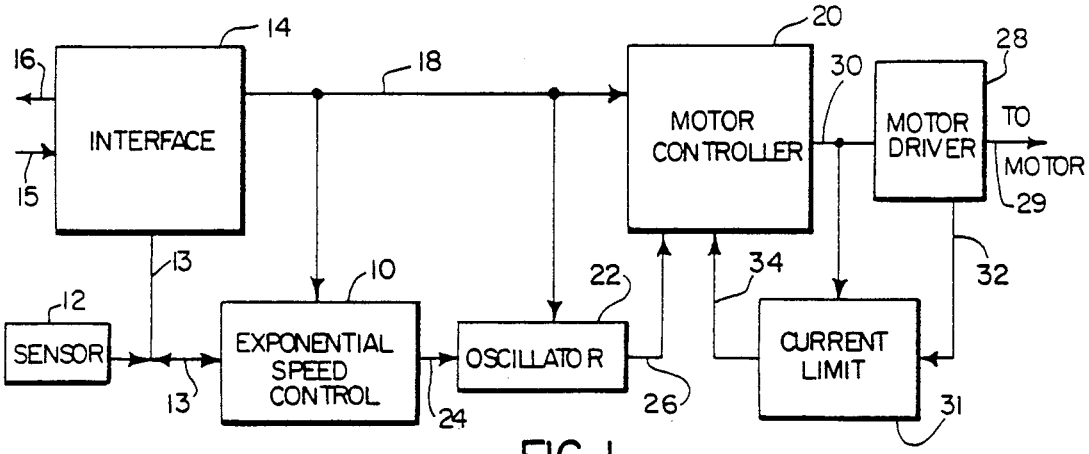
FIG. 1 is a block diagram of the control system in accordance with the subject invention.

As shown in FIG. 1, the exponential speed control 10 responds to the position of a reciprocating pump piston (not shown) relative to the pump outlet ports (not shown) and increases or decreases the speed of a pump motor (not shown) to balance the flow of fluids through the ports, based upon programmed position, pressure and volume criteria. By way of example, when the control system of the subject invention is used in conjunction with the pump and motor system of the aforementioned co-pending patent application, Ser. No. 07/648,242, the motor is programmed to operate as is shown in the timing diagram of FIG. 6. It will be readily understood by those skilled in the art that the pump cycle and speeds are a matter of choice, depending upon each specific application.

Referring specifically to FIG. 1 of the drawing, the control circuit includes the exponential speed control 10, which is in communication with a position sensor 12, and a computer interface 14. The cycle start and direction signals are introduced from the computer via line 15 into the control system through the computer interface 14. The pump position signal from the sensor 12 is introduced via line 13 to the interface 14 and through the interface 14 to the computer via line 16. In operation, the control system is actuated by entering a START signal on line 15 from the computer. In response to the START signal, an ENABLE signal is generated on line 18 and is introduced into the motor control 20, the oscillator 22 and the exponential speed control 10. At this point, the pump system is at the beginning of its cycle and is in communication with the inlet port of the pump, and the motor is operating at its INITIAL speed.

Figure 6:
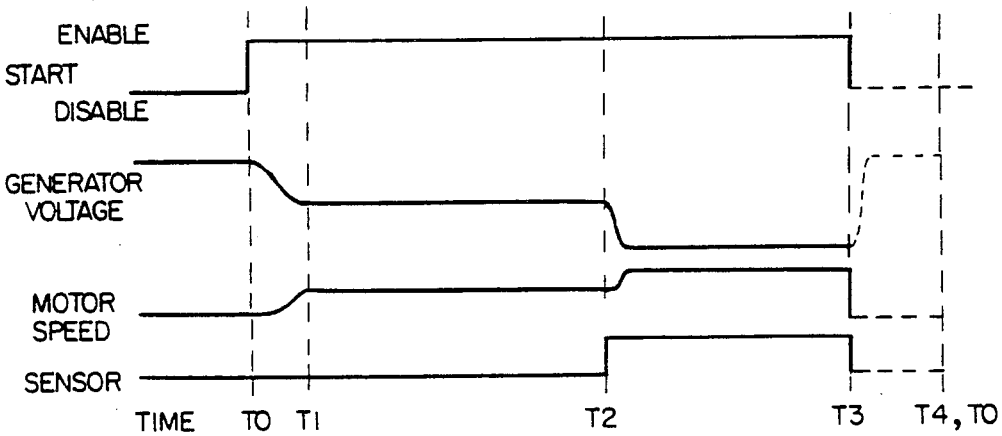
FIG. 6 is a timing diagram of a typical pump cycle as controlled by the control system of the subject invention.

As shown in FIG. 6, the STARt signal on line 15 of FIG. 1 is introduced from the computer (not shown) to the interface 14 at time 0. At this point, the voltage level on line 18 is shifted from LOW or "disable" to HIGH or "enable". This signal is introduced into the motor controller 20 and the exponential speed control 10. The motor controller now produces a signal on line 30, signalling the motor driver 28 to produce a drive signal on line 29 for driving the motor. The signal on line 18 is also introduced into the voltage control oscillator 22. At this point, the signal on line 24 from the exponential speed control 10 causes the output frequency of the oscillator to increase from disabled initial voltage state to a FIRST ENABLED state and this is introduced into the motor controller 20 via line 26. The presence of the ENABLE signal in combination with the oscillator frequency signal causes the drive signal on line 29 to accelerate the pump motor from zero to its FIRST operating speed by Time 1, generally before the piston is in communication with the first sequential outlet port. The motor will continue to operate at this FIRST speed until the sensor 12 sends a HIGH signal on line 12 at Time 2, indicating that a certain point in the pump cycle has bee reached. This alters the output on line 24 of the control 10, in turn increasing the frequency on line 26 of the oscillator to its SECOND ENABLED state, thereby alterning the motor drive signal to accelerate the motor to its SECOND operating speed. The motor will continue to operate at this speed until the sensor signal on line 12 changes back to LOW at Time 3, indicating a completion of the cycle at which time the signal on line 15 drops from ENABLE to DISABLE, returning the system to the disabled state. It may now repeat the cycle at Time 4, 0.

In the present invnetion, a hybrid stepping motor is used and the speed control is dependent upon phasing of the motor. The motor phase speed control signal is on line 30 and is introduced into the motor driver circuit 28 and the current limit circuit 31. The motor driver 28 is responsive to the motor phase signal present on line 30 to produce an output on line 29, which controls the actual speed of the motor. The current limit circuit 31 monitors the output of the motor control and the response of the motor driver on line 32, and produces a correlating feedback signal on line 34.

The motor used in the preferred embodiment is a two-phase stepping motor such as any suitable model, by way of example, Models PH264-E15 with 1.8° per step. The motor peak current is changed to reduce resonance at low speeds. In the preferred embodiment, the current is liited to 0.5 amp per phase. The current is reduced to 0.37 amp per phase when two phases are ON (full-step). The initial speed of the motor uppn receipt of the ENABLE signal is 1,200 steps per second. Of course, the current level and speeds are arbitrary and are a matter of choice, depending on application. In the preferred embodiment, three discrete positions are closely monitored. These positions of the pump correspond to the following positions of the pump piston as monitored by the sensor 12:

1. Piston leading edge entering the input ports (this generally corresponds to Time 1 on FIG. 6);
2. Piston trailing edge leaving the input ports (this generally corresponds to Time 2 on FIG. 6);
3. Piston trailing edge leaving the first outlet port and, generally simultaneously, piston leading edge entering the second outlet port, which is end of cycle (this generally corresponds to Time 3 on FIG. 6).

These three discrete positions are monitored and a responsive signal on line 13 is introduced into the computer via interface 14 and line 16, and also into the exponential speed control 10. As will be described, this alters the motor speed at various points in the cycle to balance the output flow of fluids from the pump through the sequentially spaced outlet ports. Since the ports are sequentially positioned, the volume and pressure in the working chamber varies as the piston head passes through each port area. By altering the speed of the piston, the volume and pressure differential is compensated for, balancing the fluid delivery of each of the various outlet ports.

Figure 2:
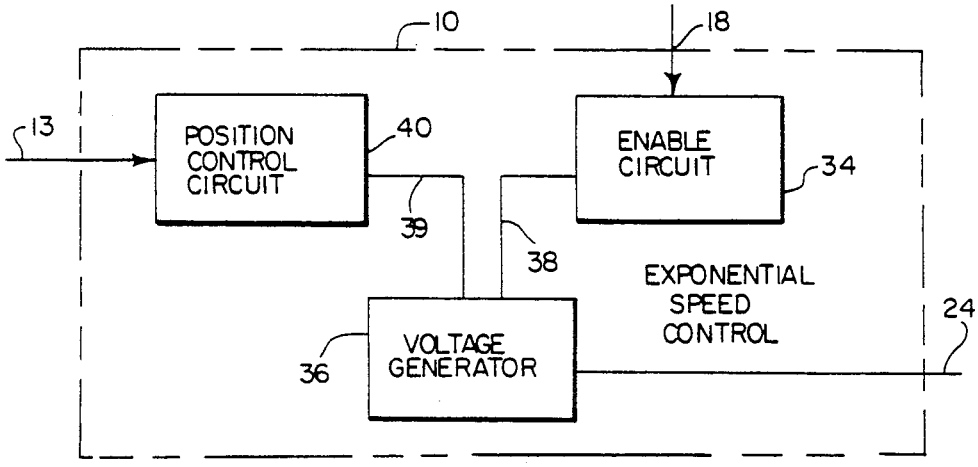
FIG. 2 is a detailed flow diagram of the exponential speed control of the control system of FIG. 1.

The exponential speed control circuit 10 of the present invention is an essential component of the motor control circuit of the present invention. In the preferred embodiment, the exponential speed control circuit contains three basic components, as shown in FIG. 2. The enable circuit 34 responds to the ENABLE signal on line 18. The position control circuit 40 is responsive to the sensor signal presented on line 13. Both the enable circuit and the position control circuit are operative to drive the ramp or voltage generator 36 to produce an output on line 24, which correlates with the position of the pump. The ENABLE signal on line 18 is introduced into the enable circuit 34, which is in direct communication with the voltage generator 36 via line 38. The position sensor 12 is associated with the pump for monitoring the rotational position of the piston and is in direct communication with the position control circuit 40 via line, 13. The position control circuit 40 selectively produces an output on line 39 in response to the position of the pump piston as monitored by the sensor 12. The signal on line 39 is introduced into the voltage generator 36.

In operation, when the ENABLE signal is initially present on line 18 and introduced into the enable circuit 34, the voltage generator is at its peak voltage state. This is output by the exponential speed control via line 24 into the oscillator circuit 22. The output of the oscillator is controlled by the voltage of the signal on line 24 and produces a controlled frequency signal on line 26 which is determined by the voltage level on line 24 for driving the motor.

When the ENABLE signal on line 18 is introduced into the enable circuit, the enable circuit is operative to energize the voltage generator 36. This begins the production of a first-controlled voltage level signal on line 24. This signal is introduced into the oscillator circuit 22, whereby the oscillator produces an altered frequency output signal on line 26 for altering the speed of the motor. The motor will now accelerate to and operate at the FIRST controlled speed until the piston reaches a predetermined point as monitored by the sensor 12. When the piston reaches the predetermined point in the pump cycle, a sensor signal is generated on line 13 and is introduced into the position control circuit 40 of the exponential speed control. The presence of the signal on line 13 activates the circuit 40 to produce an output signal on line 39, which introduced into the voltage generator 36. The signal on line 39 is operative to alter the voltage level of the output of the generator 36 and produce a second controlled voltage level signal on line 24, which is introduced into the oscillator 22. This alters the frequency of the output signal of the oscillator 22 on line 26 for altering the speed of the motor to a SECOND controlled speed.

The motor will continue to operate at the SECOND controlled speed as long as a signal is present on line 13. Once the signal on line 13 is removed, the motor will return to and operate at the FIRST controlled speed, as dictated by the signal on line 38 from the enable circuit 34. This occurs when the pump system passes a second predetermined point in its cycle, as monitored by sensor 12. The motor will continue to operate at the FIRST controlled speed as long as the ENABLE signal is present on line 18 and no signal is present on line 13. In the preferred embodiment, and as shown in FIG. 6, the ENABLE signal and the signal on line 13 are simultaneously disrupted and the motor decelerates from the second speed to zero. At the end of the cycle, the ENABLE signal on line 18 is canceled and the motor stops. At the initiation of a new cycle, the sequence is repeated.

Figure 3:
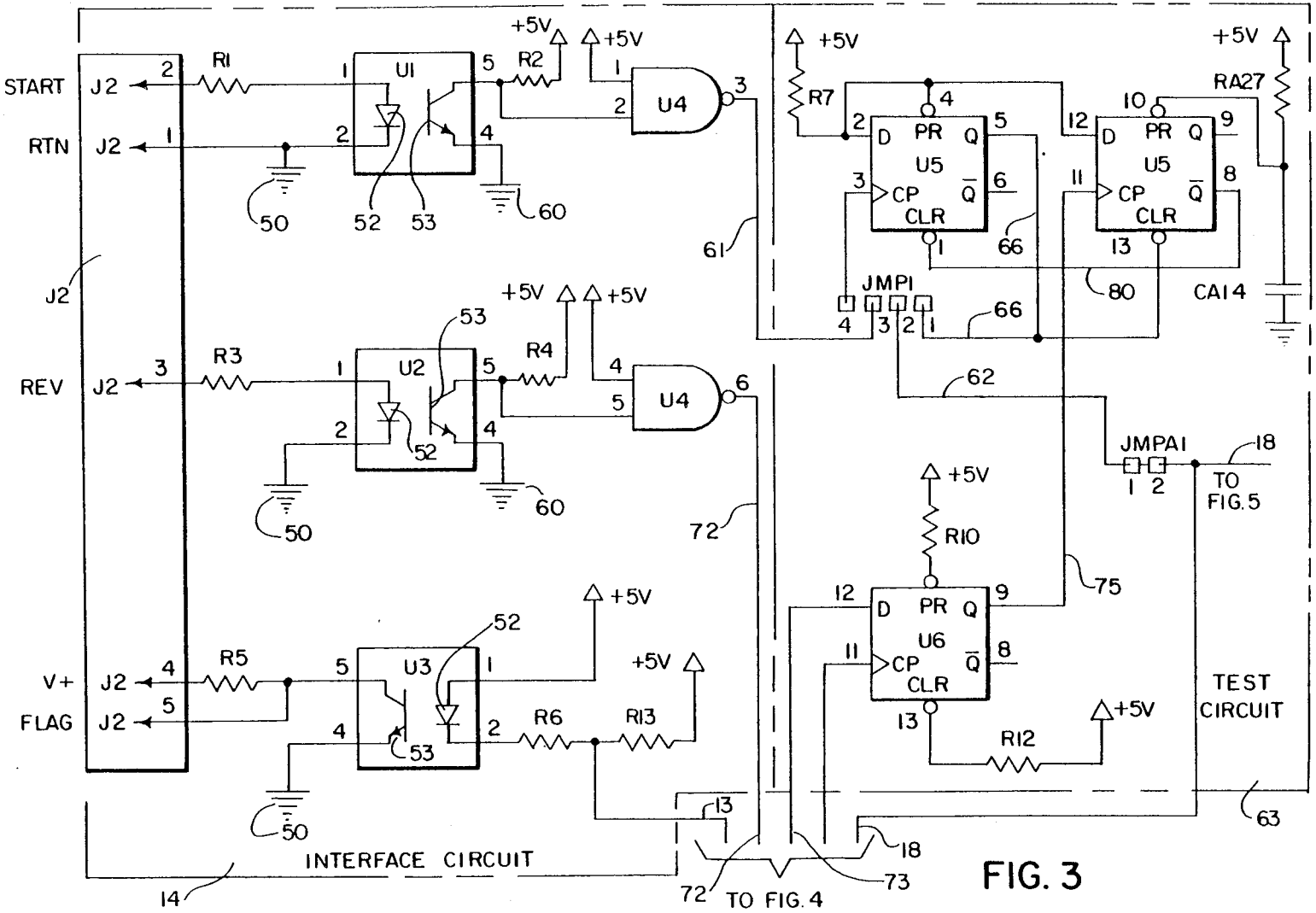
FIGS. 3-5 comprise a schematic circuit diagram of the control circuit illustrated in FIGS. 1 and 2.
Figure 4:
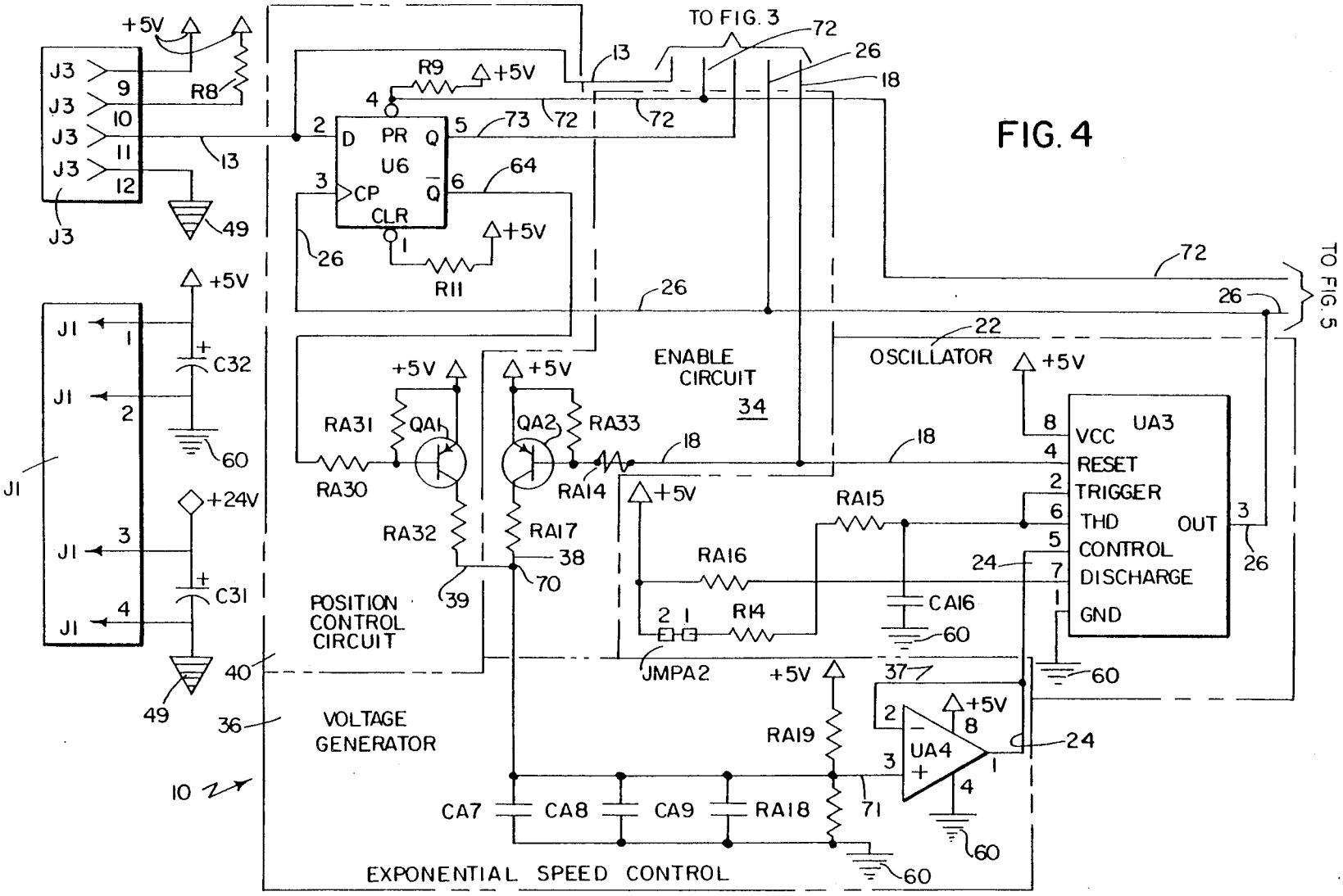
Figure 5:
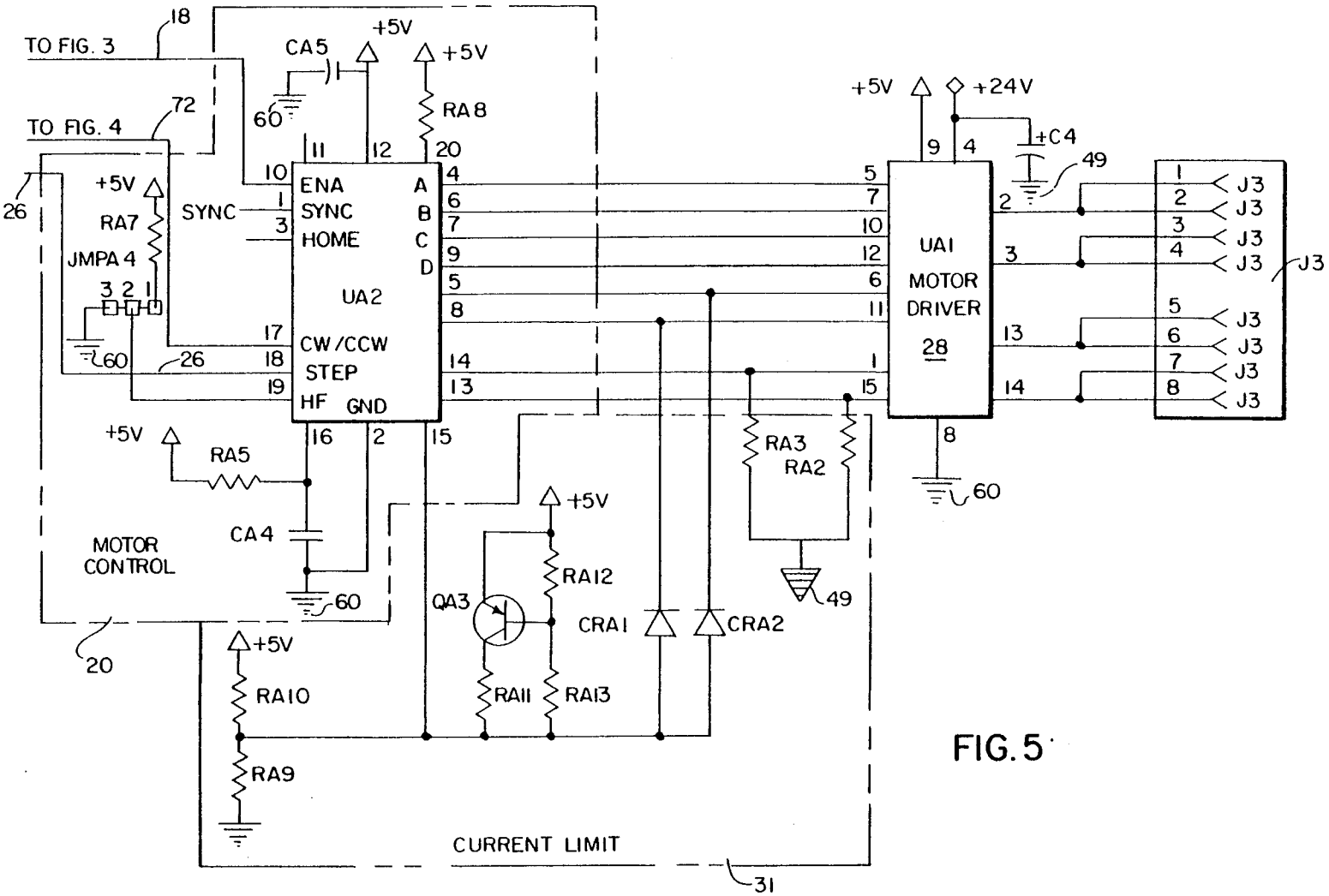

A detailed schematic diagram of a circuit for a control system in accordance with the subject invention is shown in FIGS. 3–5. The pin numbers throughout the drawing are those used as standard nomenclature by the industry and as supplied by the manufacturers. As there shown, the connector J1 (FIG. 4) is used to connect the power sources to the control system. Pin 1 of connector J1 is connected to a positive 5 volt DC source and, through the 100 microfarad decoupler capacitor C32, to control system ground 60 with a return line through pin 2. Wherever a 5 volt positive DC source is shown throughout the drawing it is coupled to the 5 volt source provided by pin 1 of connector J1. The 24 volt source for driving the pump motor via pin 4 of motor driver UA1 (FIG. 5) is supplied through pin 3 of connector J1, and through the 100 microfarad decoupler capacitor C31 to pump ground 49 and to the return line via pin 4.

The connector J2 is adapted for connecting the optical interface circuitry 14 with a computer or other programmer (not shown). In the preferred embodiment, the START signal is introduced into the connector J2 from the computer and is present on pin 2. The RETURN (RTN) signal is present on pin 1. The REVERSE (REV) signal is present on pin 3. The signal generated by sensor 12 on line 13 is introduced into the interface 14 and, as will be described, is introduced into the computer via pin 5 of the connector J2. In the preferred embodiment, a 5 volt positive DC source signal is present on pin 4 of the connector J2, and through the 1K ohm resistor R5 pulls up the sensor signal present on pin 5.

The computer generated signals present on pins 2 and 3 of the connector J2 are introduced into the respective integrated optical interface circuit chips or modules U1 and U2, such as the generic 4N33 interface shown. As shown in FIG. 3, the START signal on pin 2 is presented to pin 1 of the interface chip U1 through a 270 ohm current limiting resistor R1. The REVERSE signal on pin 3 is introduced into pin 1 of the 4N33 interface chip U2 through a 270 ohm current limiting resistor R3. The input side of each of the interface chips U1 and U2 includes a diode-type element 52 between pins 1 and 2, whereby a signal passes from pin 1 through diode 52 and pin 2 to isolated ground 50. The isolated ground terminal 50 is electrically isolated from the remainder of the control circuitry on the output sides of the interface chips U1 and U2.

With the specific reference to the circuitry for the START signal, it will be understood that the presence of the START signal on pin 1 of chip U1 generates a signal 1. through the diode element 52 for driving the optically isolated transistor 53. This produces an output signal on pin 5 of the chip U1. Pin 4 is connected to system ground 60, which is the common control circuit ground as indicated throughout the drawings. The output signal present on pin 5 of interface U1 is introduced into a 74LS00 buffer U4 at input pin 2 to produce an output on pin 3 and line 61. As shown, the 5 volt DC source is connected to input pin 1 of the buffer U4. Pin 5 of the module 41 is connected to the 5 volt DC source through the 1000 ohm pull-up resistor R2.

The REVERSE signal line from pin 3 of the connector J2 is introduced into pin 1 of a 4N33 interface chip U2 through the 270 ohm current limiting resistor R3. Whenever a REVERSE signal is present on pin 3 of the connector J2, an output is produced at pin 6 of the 74LS00 buffer U4 and on line 72 in the same manner as the START signal is produced on pin 3 of the buffer.

The interface circuit 14 also includes the 4N33 optical interface chip U3 for introducing to the computer the sensor signal produced on line 13 by the sensor 12. The signal on line 13 is introduced to pin 2 of the interface chip U3 through the 470 ohm current limiting resistor R6. The 5 volt positive DC source is supplied through the 4.7K ohm resistor R13 to pull up the signal on pin 2 to bias the signal into an OFF state. The 5 volt source is also supplied to pin 1 of the chip U3, as shown. Whenever a signal is present on line 13 and therefore, on pin 2 of the interface chip U3, an output signal is produced on pin 5 of the interface chip and is introduced to pin 5 of the connector J2 for supplying the sensor signal to the computer. The chip U3 operates in the same manner as the chips U1 and U2.

As shown in FIGS. 3 and 4, the signal produced at pin 3 of buffer U4 and on line 61 is tied to pin 3 of jumper JMP1 which, in the operating mode, is tied to pin 2 of jumper JMP1 for producing the ENABLE signal on line 62. Line 62 is tied to line 18 through pins 1 and 2 of jumper JMP1. The ENABLE signal on line 18 is introduced to pin 4 of the NE555 oscillator UA3 and into the transistor QA2 of the voltage modulator 34 through the 4.7K ohm current limiting resistor RA14. The ENABLE signal on line 18 is also tied directly to pin 10 of the L297 motor controller chip UA2 (FIG. 5). Pins 1 and 4 of jumper JMP1 are used for coupling an optimal test circuit 63, as further described herein.

It will be understood that whenever a START signal is generated by the computer, an output signal is continuously present at the output pin 3 of buffer U4. This signal produces the ENABLE signal on line 18 which is introduced to the motor control 20 at pin 10 of the chip UA2, to the reset pin 4 of oscillator UA3, and to the drive transistor QA2 of the enable circuit 34. This starts the oscillator UA3, producing an output frequency on line 26 at pin 3 of the oscillator, as controlled by the voltage applied to pins 5 of the oscillator by line 24 from the voltage generator 36. This output signal is introduced into the motor control chip UA2 at pin 18. The 5 volt power source is coupled to the oscillator via pin 5. The oscillator is grounded to system ground 60 via pin 1. "Trigger" pin 2, "THD" pin 6 and "discharge" pin 7 are controlled by the RC network comprising the 499K ohm resistor R14, the 10K ohm resistor RA15 and the 348 ohm resistor R16, and the 0.01 microfarad capacitor CA16 which is coupled to ground 60. In the preferred embodiment, the 5 volt DC power source is optionally connected to resistor R14 via pins 1 and 2 of jumper JMP2 to modify the RC time constant.

When the ENABLE signal on line 18 is presented to reset pin 4 of the oscillator UA3, the oscillator is enabled to produce a controlled frequency output on line 26 at pin 3 in response to the voltage level applied at pin 5. The frequency signal on line 26 is introduced into the motor control chip UA2 at pin 18.

As shown in FIG. 5, the L297 motor control chip UA2 is coupled to the 5 volt DC power supply at pin 12 and through the 10K ohm resistor RA8 at pin 20. The ENABLE signal on line 18 is introduced at pin 10. A synchronizing signal may be selectively introduced at pin 1. Typically, the synchronized signal is used when multiple control circuits are used in combination to control a plurality of pump systems in a single, multiple station system. Here, for simplicity of explanation, only a single pump system is described.

The REVERSE signal on line 72 is introduced at pin 17 and the oscillator output signal on line 26 is introduced at pin 18. Pin 19 is coupled through jumper JMPA4 to the 5 volt DC power supply through the 10K ohm pull up resistor RA7. An RC timer chopping circuit comprising the 10K ohm resistor RA5 and the 0.0068 microfarad capacitor CA4. The motor control is grounded via pin 2. The four phase outputs A, B, C and D are on pins 4, 6, 7 and 9, respectively. Pins 5 and 8 provide signals for enabling the half step motor phase sequence. Pins 13 and 14 monitor current through the motor windings. Pin 15 of the motor control chip UA2 is connected directly to the current limit reference circuit 31, as will be explained. The 1 microfarad capacitor CA5 provides noise suppression.

When the oscillator signal on line 26 is received at pin 3, the motor control chip UA2 produces an output on one of the four phase output pins A, B, C and D. This in introduced into the motor driver 28 at the L298 driver chip UA1, pins 5, 7, 10 and 12, respectively. This produces a respective output at pins 2, 3, 13 and 14 of the driver chip UA1, which is tied directly to the pump motor via connector J3 for driving the pump. The 5 volt power source is supplied to driving the motor driver chip UA1 at pin 9. The 24 volt power source for powering the motor is connected to pin 4. The driver chip UA1 is grounded at pin 8. The outputs on pins 2, 3, 13 and 14 are coupled directly to pins 1, 2, 3 and 4 of connector J3 for providing the phase controlled speed inputs to the motor. Pins 1 and 15 of the motor driver chip UA1 are connected directly to pins 13 and 14 of motor control chip UA2 to measure the current in each winding of the motor. The 24 volt power source is decoupled through the 10 microfarad capacitor C4. The capacitor C4 and resistors RA2 and RA3 are tied to pump ground 49.

Once the ENABLE signal on line 18 is generated, it is introduced into the exponential speed control 10 and to the transistor QA2 through the 4.7K ohm current limiting resistor RA14. This pulls up or turns OFF the transistor AQ2, permitting the voltage signal generator 36 to "ramp down" (see FIG. 6) to a different voltage signal level at pin 1 of amplifier UA4. The transistor QA2 is powered by the 5 volt power suppy which is also connected to the driver side of the transistor through the 4.7K ohm resistor RA33.

In the preferred embodiment, the voltage generator 36 comprises three 1 microfarad capacitors CA7, CA8 and CA9 connected in parallel with the 10K ohm resistor RA18 and tied to the 5 volt DC source through 25.1K ohm resistor RA19. The parallel capacitive resistance circuit comprising the capacitors CA7, CA8 and CA9 and the resistor RA18, RA19, RA17, RA32, define a ramp generator having an output which is tied directly to pin 3 of the LM348 amplifier UA4. This produces a control signal on output pin 1 of the amplifier, which is tied back to pin 2 of the amplifier by a unitary feed back loop 37. The amplifier is powered by the 5 volt DC power supply connected at pin 8 and is grounded to system ground at pin 4.

The control signal produced at pin 1 of the amplifier UA 4 is tied directly to the control pin 5 of the oscillator US3 via line 24. This controls the frequency of the output produced at pin 3 of the oscillator UA3 and on line 26. As the voltage on line 24 changes in response to the voltage generator 36, it is transmitted to the oscillator and a corresponding responsive signal is produced at output pin 3 and on line 26. The signal on line 26 is tired to pin 18 of the motor control chip UA2. The output produced on pins A, B, C and D of the motor control chip UA2 is in direct correlation with the frequency produced by the voltage generator 36. Thus, the speed of the motor correspondingly changes in response to the change in frequency of the output of the ramp generator 36.

In the preferred embodiment, it will be noted that an output is produced on pin 1 of the amplifier UA4 in direct response to the initial presence of an ENABLE signal on line 18. This produces an initial output control signal and initiates operation of the motor at the INITIAL speed. At the same time, the transistor QA2 responds to the ENABLE signal on line 18 and is operative to alter the signal on line 38 to the voltage generator. This permits the generator output voltage to "ramp-down" (see FIG. 6) to a different voltage level signal at pin 1 of amplifier UA4. This is introduced into the control pin 5 of the oscillator UA3. THe oscillator output frequency on line 26 is correspondingly altered, to likewise alter the output on pins A, B, C and D of the motor control module UA2. This "ramps up" the motor speed to the FIRST controlled speed (see FIG. 6).

As previously described, a sensor 12 is associated directly with the rotating piston of the pump and moitors the precise location of the pump at any point during its cycle. The sensor is connected directly to the exponential speed control 10 via pin 11 of the connector J3. In the preferred embodiment, pin 11 of the connector J3 is connected directly to pin 2 of the 74LS74 flip-flop U6 via line 13. At predetermined point in the cycle of the pump, the "flag" signal is generated by the sensor and this is introduced to pin 2 of the flip-flop U6. The 5 volt DC power source is connected to the flip-flop U6 at pin 4 through 10K ohm pull up resistor R9. The "clear" (CLR) pin 1 of the flip-flop is connected to the 5 volt DC power source via the 10K ohm pull up resistor R11. The "$\overline{Q}$" output of the flip-flop is produced on pin 5 and the "Q" output of the flip-flop is produced on pin 6. Pin 3 is the "CP" pin for the flip-flop U6.

As is well understood in the art, the "Q" output on pin 6 of the flip-flop U6 is controlled by the "D" output and clock signal on pins 2 and 3, respectively. At start up (T0 on FIG. 6) the signals are as shown on FIG. 6. During start-up and initiation, the T1 status is achieved. As soon as a "flag" signal is generated on oine 13 by the sensor 12, the flip-flop U6 is tripped, likewise tripping the signal on pin 6 (T2 on FIG. 6). The output on in 6 is tied directly to the position control transistor QA1 via line 64 through the 4.7K ohm resistor RA30. The 5 volt DC power supply is tied to the resistor and back through the driver through the 4.7K ohm resistor RA31. When the signal is present on line 64 from pin 6 of the flip-flop U6, the transistor is pulled up and no current is present on line 39 (T3 on FIG. 6). During this phase, the generator 36 is driven only by the voltage across resistors RA19 and RA18. As soon as the "flag" signal is produced by the sensor 12 (T3 on FIG. 6), indicating a predetermined position of the pump in its cycle, the flip-flop U6 is tripped and the signal on line 64 is canceled. This enables the transistor QA1 to generate a current through the 10K ohm resistor RA32 on line 39. This is tied to line 38 at node 70 in the frequency generator 36 and is combiend theewith to alter the input to the RC ramp generator. This causes the generator to produce an altered output on line 71 which is input at pin 3 of the amplifier UA4. A similarly altered output is produced on output pin 1 of the amplifier UA4 and is introduced into the oscillator UA3 at pin 5 via line 24.

This altered signal produces a modified control signal on pin 3 of the oscillator chip UA3 which is introduced via line 26 into pin 18 of the motor control UA2. The altered signal on pin 18 controls the output signal of the motor control UA2 at pins 4, 6, 7, 9, 14 and 13 for controlling and modifying the speed of the pump motor through motor driver 28. When this condition is present, the motor operates at the SECOND controlled speed. As soon as signal on line 13 is canceled (T3 on FIG. 6), indicating movement of the pump past the "flagged" portion of its cycle, an output is again produced at pin 6 of the flip-flop U6 and on line 64, latching the transistor QA1 and enabling the current on line 39. The START signal is also canceled and the motor is returned to the rest state (T0 on FIG. 6).

The preferred embodiment of the invention permits the pump motor to run in a reverse cycle at programmed intervals, to further control the speed of the pump and where desired, to purge the fluid lines associated with the pump. When the REVERSE (REV) signal is presented by the computer to pin 3 of the connector J2, and is output at pin 8 of the buffer U4 and on line 72, it is introduced into pin 4 of the flip-flop U6 (FIG. 4) to latch pin 8 in the "LOW" or "OFF" condition for producing a signal on line 64. Two buffers are used to reverse signal polarity. The signal is normally HIGH and is activated LOW when the reverse signal is active. This locks ON the production of the signal on line 39, irrespective of the position of the piston as monitored by the sensor 12 and irrespective of the prsence of a "flag" signal on line 13. At the same time, the signal present on line 72 is introduced into pin 17 of the motor control UA2 (FIG. 5) for reversing the rotation of the motor from clockwise to counterclockwise by reversing the phase sequencing of the output signals from the control UA2. As soon as the REVERSE signal on pin 3 of connector J2 is canceled, the signal at pin 10 and on line 72 goes HIGH, raising the input to pin 17 of the motor control UA2 and to pin 4 of flip-flop U6. This permits the motor control UA2 to operate in the normal or forward mode and enables the flip-flop U6 to permit the "Q" output on pin 6 to respond directly to the signal on line 13.

As shown in FIG. 5, the control system of the preferred embodiment includes a current limit circuit 31 tied to pins 6 and 11 of the motor drive UA1 and pins 5 and 8 of the motor control UA2. The transistor QA3 is driven with the emitter connected to the 5 volt power source and the 4.7K ohm base-emitter bias resistor RA12. The output signal as defined by the voltage divider network comprising teh 39K ohm resistor RA11, the 15K ohm resistor RA10 and the 1.8K ohm resistor RA9, is introduced to pin 15 of the motor control unit UA2. Whenever a signal is present on pin 5 or pin 8 of the motor control UA2, this is introduced through the respective IN4001 diodes CRA1 and CRA2 to control the operation of the transistor QA3. The diodes CRA1 and CRA2 operate as an "OR" circuit, whereby the transistor Q3 is responsive to the presence of the signal on either pin 5 or pin 8 of control UA2. When a signal is present across either of the diodes, it is introduced into the transistor QA3 through the 10K ohm resistor RA13. The current limit circuit is operative to limit the drive current of the motor by controlling the logic level on the phase output pins A, B, C and D in response to the motor step phase as read on pins 5 and 8 of the motor control UA2. The signal to pin 15, produced by the current limit circuit 31 is controlled by the 5 volt DC power source as altered by the voltage divider circuit comprising the 15K ohm resistor RA10 and the 1.8K ohm resistor RA9, tied to pump ground 49.

An RC timer chopping circuit is provided by the 0.68 microfarad capacitors CA4, and a 10K ohm resistor RA5, which are tied directly to pin 16 of the motor control UA2. The RC timer circuit determines the rate at which the driver UA1 is modulated in response to the signal present on pins 13 and 14 of the motor control UA2.

In the preferred embodiment, an optional test circuit 63 (FIG. 3) is provided to permit for testing of the control system prior to installation and connection to a computer. As shown, jumper JMP1 may be opened between pins 2 and 3. The START signal line 61 is then temporarily tied to a signal source and through jumper JMP 1 pins 3 and 4 to pin 3 of the 74LS74 flip-flop U5. The 5 volt DC power supply is tied to pins 2, 4 and 12 of the flip-flop U5 through the 10K ohm pull up resistor R7. The 10K ohm resistor RA27 and the 0.1 microfarad capacitor CA14 are connected to pin U5-10. They provide a predetermined known time constant used to force the flip-flop into a known state when power is applied to the circuit. The "Q" output pin 5 of flip-flo pU5 is tied to line 66 and the not "Q" output pin 8 of U5 is tied back to clear CLR pin 1. Line 66 is tied to clear CLR pin 13 and through jumper pins 1 and 2 to line 62 of the circuit. The "CP" pin 11 of flip-flop U5 is tied directly to the "Q" output pin 9 of flip-flop U6 via line 75. A logic state ONE is supplied to pin 4 of flip-flop U6 via the 5 volt DC power supply source through the 10K ohm pull up resistor R10. The "CLR" pin 13 of flip-flop U6 is connected to the 5 volt DC power supply through the 10K ohm pull up resistor R12.

When the signal present on pin 3 of the flip-flop U5 changes from logic "0" to logic "1", this causes the output on the "Q" output in 5 of flip-flop U5 to go HIGH or logic "1". This output is introduced via line 66 and pins 1 and 2 of the juper JMP1 to line 62 of the circuit, where it is tied to pin 10 of the motor control UA2 via jumper jMP1 and line 18. It is also introduced into the reset pin 4 of the oscillator UA3 and to resistor RA14 of the voltage modulator 34. As long as the signal is present on line 18, the circuit will operate in the same manner as described when a "START" signal is presented by the computer to connector J2. At the same time, the output of the "Q" pin 5 of flip-flop U5 is introduced into pin 13 of flip-flop U5. When a signal is present on line 13 from sensor 12 (FIG. 4), a signal is generated on the "Q" output pin of flip-flop U6 and is introduced therefrom to pin 12 of flip-flop U6 via line 73. This produces a delayed output on the "Q" output pin 9 of flip-flop U6, which is introduced via line 75 into pin 11 of flip-flop U5. As soon as the delayed signal is applied from line 75 causes the output on pin 9 of flip-flop U6 is raised, an output is produced on "$\overline{Q}$" pin 8 of flip-flop U5 and introduced via line 80 to pin 1 of flip-flop U5 for clearing and resetting the flip-flop and indicating the end of a test sequence on line 66. Resetting the "Q" output on U5 pin 5 also clears the other flip-flop through line 66 connected to U5 pin 13. The test logic circuitry is bypassed by closing pins 2 and 3 of jumper JMP1 when installing the circuit in a pump system and connecting it to the computer.

While certain features and embodiments of the invention have been described in detail herein, it will be understood that the invention includes all enhancements and modifications within the scope and spirit of the following claims.

I claim:

1. A method of controlling the speed of a metering pump having a rotating piston, comprising the steps of:

a. rotating the piston at a first controlled speed in response to the presence of a first preselected stimulus; and b. altering the rotating speed of the piston to a second controlled speed in response to the presence of a second preselected stimulus.

2. The method of claim 1, including the additional step of placing the piston in a rest condition when said first and second preselected stimulus are removed.

3. The method of claim 2, wherein said first preselected stimulus is always present when the pump is operating and said first controlled speed is initiated only after a preselected time delay, said speed of rotation of the piston being accelerated from the rest condition to the first controlled speed during said time delay.

4. The method of claim 1, including the additional steps of normally rotating the piston in a forward direction and reversing the direction of rotation of the pump in response to the presence of a third preselected stimulus.

5. The method of claim 4, wherein said second preselected stimulus is rendered inoperative whenever said third preselected stimulus is present.

6. A method of controlling the rotational speed of the piston of a metering pump, comprising the steps of:

a. generating an enabling signal operative for rotating a piston;

b. after a preselected time delay, producing a first control signal in response to the presence of the enabling signal, said first control signal operative for rotating the piston at a first controlled speed; and c. producing a second control signal in response to a preselected angular position of rotation of the piston, said second control signal operative for rotating the piston at a second controlled speed.

7. The method of claim 6, including the additional step of monitoring the angular position of the rotating piston for producing said second control signal in response to the piston rotating to a preselected monitored angular position.

8. The method of claim 6, wherein said enabling signal is always present when said piston is rotating.

9. The method of claim 8, wherein said second control signal can be produced only when said first control signal is present.

10. The method of claim 6 further including the steps of normally rotating the piston in a forward direction and selectively producing a reversing signal operative for rotating the piston in a reverse direction.

11. The method of claim 10 further including the step of precluding the production of said second control signal whenever said reversing signal is present.

12. A control system for controlling the speed of rotation of a rotating piston in a pump as the piston cycles sequentially from an inlet port to a first outlet port and a second outlet port and to the inlet port, comprising:

a. means for monitoring the angular rotational position of the piston and operative for producing a signal when said piston is at a preselected angle of rotation;

b. means associated with the pump and operative for driving the piston at a first controlled speed of rotation when it is in a first preselected angular position; and c. means for driving the piston at a second controlled speed of rotation when it is in a second preselected angular position.

13. The control system of claim 12, including means for selectively driving the pump piston in forward and reverse directions of rotation.

14. The control circuit of claim 12, including means for monitoring the current load conditions of the pump and altering said first and second controlled speeds of rotation for maintaining said current load conditions within a specified range.

15. The control circuit of claim 12, wherein each of said means for driving the pump piston further includes a common signal generator and a first means responsive to initiation of rotation of the piston for enabling the generator to produce a first control signal for driving the piston at the first controlled speed, and a second means responsive to the movement of the piston to a preselected angle of rotation for enabling the generator to produce a second control signal for driving the piston at the second controlled speed.

16. A control system for controlling the speed of rotation of the rotating piston of a metering pump as the piston cycles sequentially from an inlet port of the pump to a first outlet port and a second outlet port and back to the inlet port, in sequence, comprising:

a. monitoring means associated with the piston for monitoring the position of angular rotation of the piston and adapted for producing a signal in response to movement of the piston to a preselected angle of rotation;

b. means for generating an enabling signal adapted for activating the pump cycle;

c. drive means responsive to the presence of an enabling signal for driving and rotating the piston of the pump in a first direction at a first controlled speed; and d. speed control means responsive to the monitoring signal for producing a second control signal for altering the speed of rotation of the piston to a second controlled speed.

17. The control system of claim 16, further comprising means associated with the drive means and adapted for selectively generating a signal for reversing the direction of rotation of said piston.

18. The control system of claim 16, wherein the exponential speed control further comprises:

a. first means responsive to the presence of an enabling signal for generating an activation signal;

b. a position control module responsive to the presence of a monitoring signal for generating an alteration signal; and c. a control signal generator responsive to the presence of the activation signal for generating said first control signal, said control signal generator being responsive to the presence of the alteration signal for generating said second control signal.

19. The control system of claim 18, wherein said control signal generator is responsive to said alteration signal only when said activation signal is present.

* * * * *